US005622440A

United States Patent [19]

Yamamoto et al.

[11] Patent Number: 5,622,440

[45] Date of Patent: Apr. 22, 1997

[54] INK FILM CASSETTE HAVING A TORQUE APPLYING DEVICE THEREIN

[75] Inventors: Junichi Yamamoto, Hadano; Chiharu Imaseki, Yokohama; Hideaki Shimizu, Inagi; Atsuhiko Shimoyama, Machida, all of Japan

[73] Assignee: Minolta Co., Ltd., Osaka, Japan

[21] Appl. No.: 489,593

[22] Filed: Jun. 12, 1995

[30] Foreign Application Priority Data

Jun. 14, 1994 [JP] Japan ..... 6-132305

[51] Int. Cl.[6] ..... B41J 32/00

[52] U.S. Cl. ..... 400/234; 400/208; 400/246; 400/218

[58] Field of Search ..... 400/208, 246, 400/234, 242, 218, 235

[56] References Cited

U.S. PATENT DOCUMENTS

| | | | |
|---|---|---|---|
| 4,660,053 | 4/1987 | Tsutsumi et al. | 346/76 PH |
| 4,768,039 | 8/1988 | Akutagawa | 400/236 X |
| 5,370,470 | 12/1994 | Kim | 400/234 |

FOREIGN PATENT DOCUMENTS

| | | | |
|---|---|---|---|
| 60-174676 | 9/1985 | Japan . | |
| 197267 | 9/1986 | Japan | 400/234 |
| 63-221076 | 9/1988 | Japan . | |
| 297085 | 12/1988 | Japan | 400/234 |
| 193221 | 8/1993 | Japan | 400/234 |

*Primary Examiner*—Christopher A. Bennett
*Attorney, Agent, or Firm*—Brinks Hofer Gilson & Lione

[57] ABSTRACT

An ink film cassette which is detachably attached to a thermal transfer recording device, the ink film cassette having a supply reel winding an ink film therearound, a take-up reel which rolls up the ink film fed out from the supply reel and a torque limiter which is provided between the supply reel and a frame of the body of the thermal transfer recording device so as to apply torque to the supply reel.

15 Claims, 12 Drawing Sheets

FIG. 8 (a)
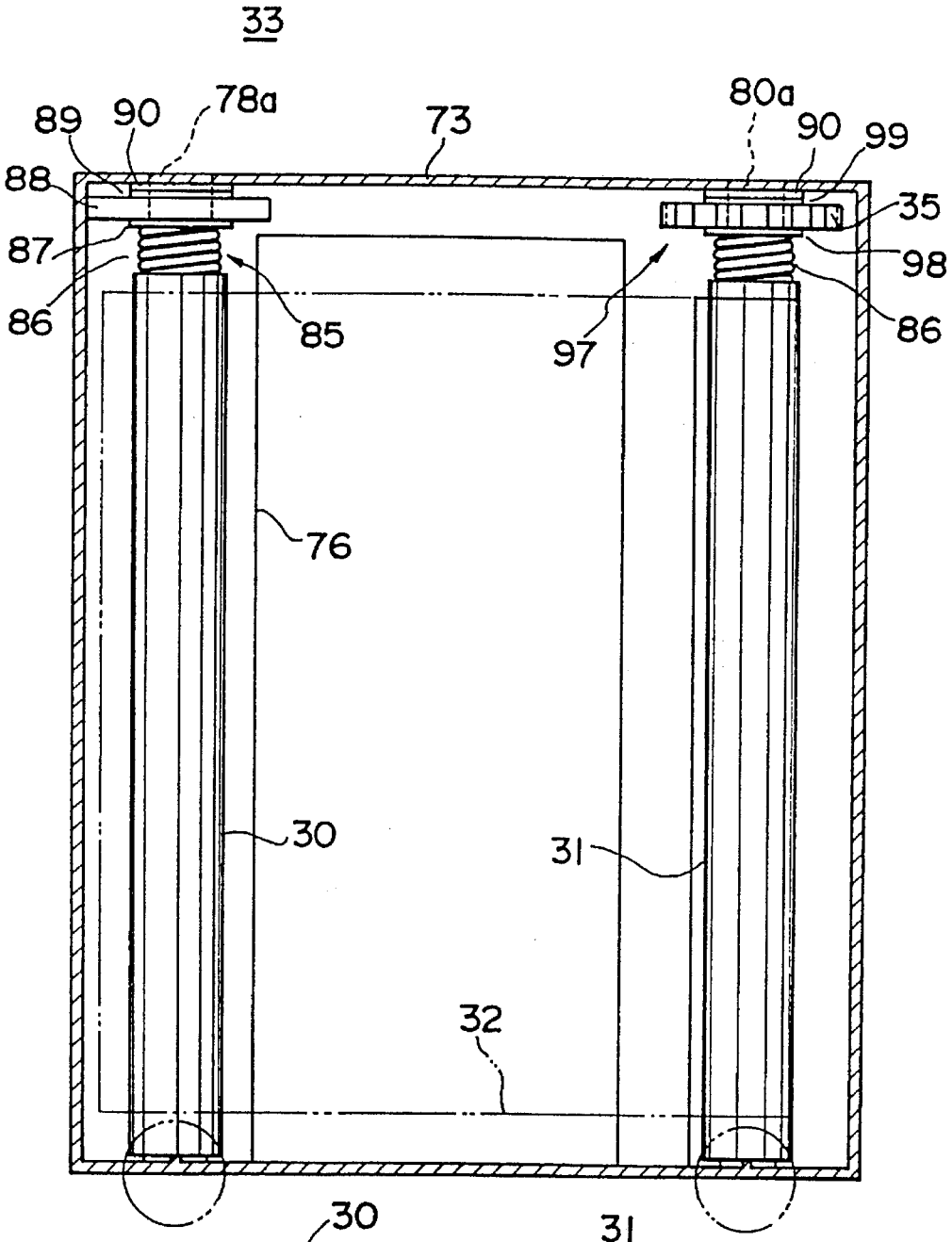
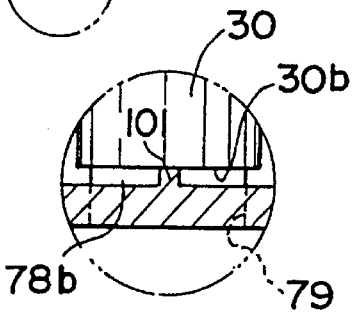
FIG. 8 (b)
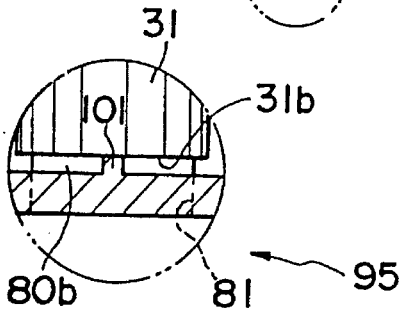
FIG. 8 (c)

INK FILM CASSETTE HAVING A TORQUE APPLYING DEVICE THEREIN

BACKGROUND OF THE INVENTION

1. Field of the Invention

The present invention relates to an ink film cassette internally accommodating an ink film used by thermal transfer recording devices.

2. Description of the Related Art

Thermal transfer recording devices are provided with a platen roller and a thermal head which can be brought into pressure contact and released from pressure contact with said platen roller, and feed a recording sheet between the platen roller and the thermal head. An ink film, the surface of which on one side is coated with heat fusion characteristics or thermal sublimation characteristics, is transported between the recording sheet and the thermal head. The ink film is fed out from a supply reel, and taken up on a take-up reel. When a color image is reproduced on a recording sheet by a single thermal head, the ink film used has a thin film base surface coated sequentially by yellow, magenta, and cyan color inks.

In thermal transfer recording devices of recent years, ink film cassettes are used which house a supply reel and a take-up reel and which are removably loaded in the body of the thermal transfer recording device so as to improve the operation of loading the ink film. Ink film cassettes are consumable components, which are replaced by a new cassette when the ink film accommodated therein has been used.

During printing, the ink film is pulled out from the supply reel and transported together with the movement of the recording sheet via the friction force with the recording sheet being transported between the platen roller and the thermal head disposed in a state of pressure contact relative to said platen roller. On the other hand, the ink film that has been fed from the supply reel is rolled up on the take-up reel via the rotation of the take-up reel rotated by a motor provided within the body of the thermal transfer recording device.

A supply torque limiter is provided within the body of the thermal transfer recording device and is connected to the supply reel when the ink film cassette is installed so as to apply a damping force on the supply reel. Tension is applied to the ink film during printing by feeding the ink film as a breaking force is applied to the supply reel by the supply torque limiter so as to prevent the ink film from wrinkling.

A take-up torque limiter for limiting the drive torque of the take-up reel is provided between the take-up reel and the motor in the body of the thermal transfer recording device. The take-up torque limiter exerts tension on the ink film during printing as previously described, and is also provided for the reasons described below. That is, although the moving speed of the recording sheet and the moving speed of the ink film must be identical during printing, the ink film take-up speed changes in conjunction with the change in the take-up diameter even though the shaft of the take-up reel is rotated at uniform speed. The take-up torque limiter is provided so that the take-up speed follows the ink film moving speed during printing to wind the ink film on the take-up reel without slack.

In conventional ink film cassettes, the supply reel and take-up reel are housed within the cassette so as to be smoothly rotated. That is, the oscillation resistance between the shaft of the supply reel and the cassette supporting said shaft, and the oscillation resistance between the shaft of the take-up reel and the cassette supporting said shaft are minimized.

During transport and delivery of the consumable ink film cassette, the ink film is easily fed from the supply reel via the application of an external force because a rotational load is not exerted on the supply reel within the cassette. Thus, a portion of the unused ink film becomes wrinkled, and needlessly rendered unusable.

Among the various used forms of ink film cassette is a typical form wherein a cassette is removed from the apparatus body before the ink film accommodated within a single cassette is completely used, then the same cassette is again reinstalled in the apparatus. In this instance, the action of an external force while the ink cassette is removed readily causes the ink film to be fed out from the supply reel and needlessly renders the ink film unusable as previously described.

Furthermore, since rotational load is not exerted on the take-up reel within the cassette when the ink film cassette is removed from the apparatus body, the application of an external force can readily cause the spent ink film to loosen and be fed out from the take-up roller, allowing possible damage to the ink film.

When the ink film becomes slack, the loose film rewinds back on the supply reel when the cassette is installed, such that an operation is required to rewind the film back on the take-up reel, thereby complicating the procedure of installation.

In order to prevent the unused film from feeding out from the supply reel and the used film from feeding out from the take-up reel, a stopper must be provided on the shaft of each reel to prevent rotation of the supply reel and take-up reel, thereby markedly complicating operation of the cassette.

Because a supply torque limiter and take-up torque limiter are provided within the body of the thermal transfer recording device, the construction of the apparatus is complicated, the cost of the device is increased, and the compact design of the device is prevented.

The torque limiters provided within the device must have durability comparable to that of other components in the device, for example, durability adequate for normally forming 60,000 images. Thus, relatively expensive torque limiters must be used, thereby increasing the cost of the component as well as the total cost of the thermal transfer recording device.

In the thermal transfer recording device, when the thermal head changes from the non-contact state to the contact state relative to the platen roller, the ink film is slightly rolled up on the take-up reel to eliminate the slack in the film. Thus, in ink film used for color printing, the regions coated with the color inks are larger relative to the print region in consideration of unused film which is slightly fed out from the supply reel. One requirement of the ink film cassette is to economize on the ink or ink film by reducing the region of the color inks.

There is a need for an ink film cassette capable of automatically eliminating film slack and maintaining a state of tension of said film when the ink film cassette is being transported, and when the cassette is removed from the thermal transfer recording device while the ink film is being used or the like.

OBJECTS AND SUMMARY

A main object of the present invention is to provide an ink film cassette which reduces the cost and simplifies the construction of a thermal transfer recording device.

Another object of the present invention is to prevent feed out of the unused ink film from the supply reel when the ink film cassette is being transported, and when the cassette is removed from the thermal transfer recording device while the ink film is being used or the like.

A further object of the present invention is to provide an ink film cassette which prevents used ink film from being fed out from the take-up reel when the cassette is removed from the thermal transfer recording device while the ink film is being used or the like.

A still further object of the present invention is to provide an ink film cassette constructed so as to economize the ink film.

An even further object of the present invention is to provide an ink film cassette capable of automatically eliminating ink film slack, and maintaining the ink film in a state of tension.

These and other objects of the present invention are accomplished by an ink film cassette which is detachably attached to a thermal transfer recording device and comprises a supply reel winding an ink film therearound, a take-up reel which rolls up the ink film fed out from said supply reel and a torque apply means provided between said supply reel and a frame of a body of the thermal transfer recording device so as to apply torque to said supply reel.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

FIG. 4(*b*) is a section view showing the operating state of the thermal transfer recording device when printing starts;

FIG. 4(*c*) is a section view showing the operating state of the thermal transfer recording device when printing ends;

FIG. 5(*b*) is a section view showing the operating state of the thermal transfer recording device when the trailing edge of the paper is cut;

FIG. 8(*a*) is a transverse section view showing the interior of the ink film cassette of FIG. 7, FIGS. 8(*a*) and 8(*c*) illustrate details of FIG. 8(*a*);

FIG. 10(*b*) is an exploded perspective view showing an example of a second torque limiter;

FIG. 15(*b*) is a section view along line 2-2 of FIG. 15(*a*).

DETAILED DESCRIPTION OF THE PREFERRED EMBODIMENTS

The preferred embodiments of the present invention are described hereinafter with reference to the accompanying drawings.

Figure 1:
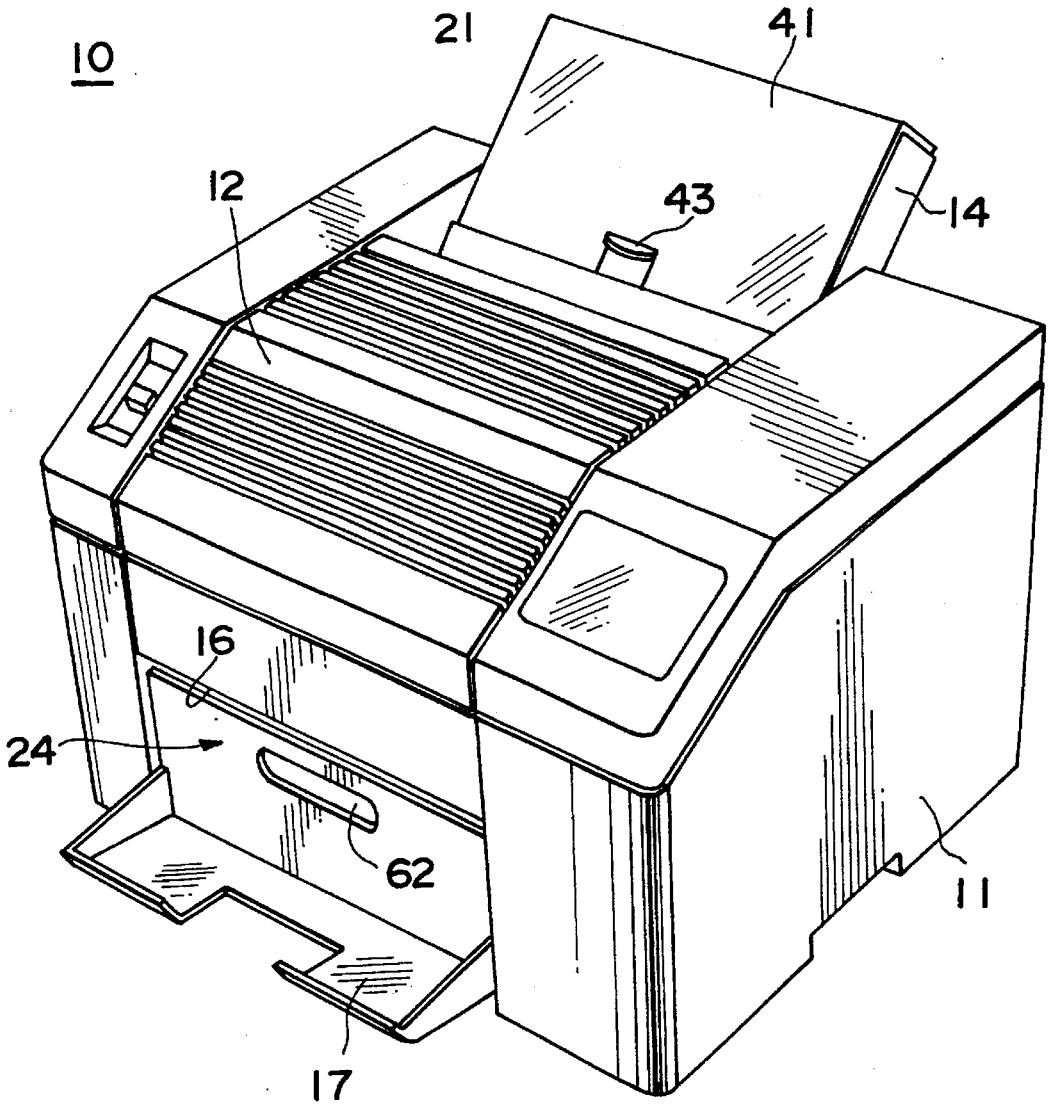
FIG. 1 is an exterior perspective view showing a thermal transfer recording device having installed therein an ink film cassette of the present invention.

FIG. 1 is an exterior perspective view showing an embodiment of the ink film cassette of the present invention removably installed in a thermal transfer recording device. In the following description, the edge of the recording paper on the leading side as the recording paper is discharged is referred to as the leading edge of the recording paper.

Thermal transfer recording device 10 shown in the drawing is used, for example, where photographic prints are developed, and is used to output so-called index printers wherein information recorded in a plurality of frames on a negative film is reproduced on a single recording sheet. A control device (not illustrated) for executing various image processing of data recorded on negative film is connected to thermal transfer recording device 10 via an interface. Image signals and control signals from the control device are input through the aforesaid interface.

Cover 12 is provided at the top of housing 11 of thermal transfer recording device 10 and is mounted thereto on oscillating shaft 12*a* (refer to FIG. 2) so as to be openable. With cover 12 in an open state, the ink film cassette is installed at a predetermined position in housing 11. The front of device 10 is shown at the front left of the drawing. A sheet discharge unit is provided at the front side, and a paper supply section 21 is provided at the back side. Paper supply tray 14 accommodating a plurality of recording sheets is provided at an incline in paper supply section 21. A sheet cutter (described later) is provided within thermal transfer recording device 10 for cutting the essential portion (leading edge and trailing edge) of the recording sheet after images are reproduced, and duster 24 for storing the cut sheets is provided at the front of the device so as to be retractable. After the essential portion is cut, the recording sheet passes through sheet discharge aperture 16, and is discharged in a vertical direction to discharge tray 17 integratedly provided at the front of cutter 24. Since the recording sheet is discharged in a vertical direction, the dimension of discharge tray 17 extending from the front surface of housing 11 is relatively small. Supply tray 14 is disposed at a incline. Accordingly, the entire thermal transfer recording device 10 occupies a small installation space, such that the recording device is suitable for locations with limited space available.

In thermal transfer recording device 10 of the present embodiment, thermal transfer recording device uses ink film coated with ink having thermal sublimation characteristics. Paper having a thickness of 150~250 μm and stiffness suitable for printing is used as the recording sheet which traps the sublimated ink to receive an image.

Figure 2:
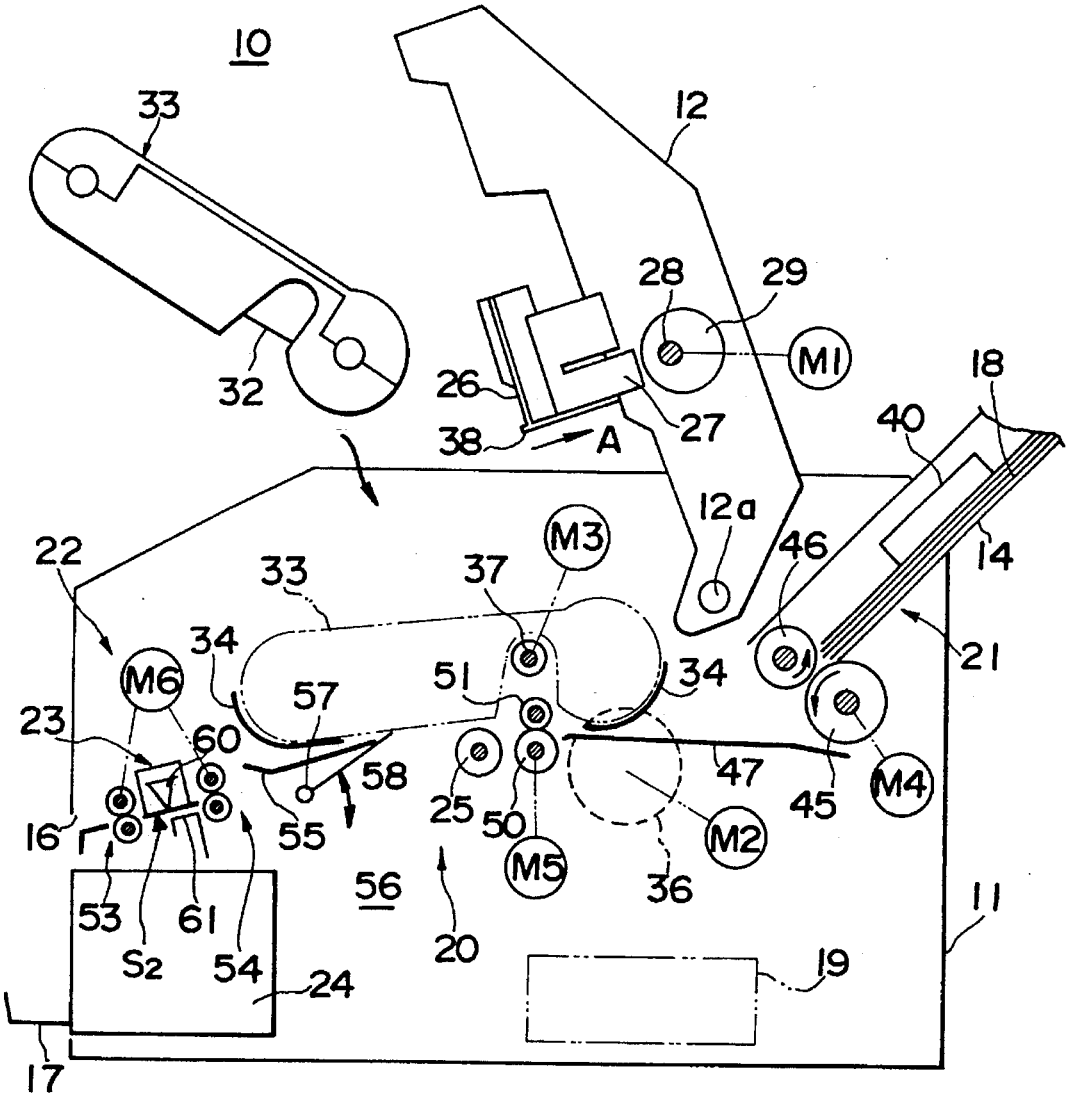
FIG. 2 is a brief section view showing the interior construction of the thermal transfer recording device with the cover open.
Figure 3:
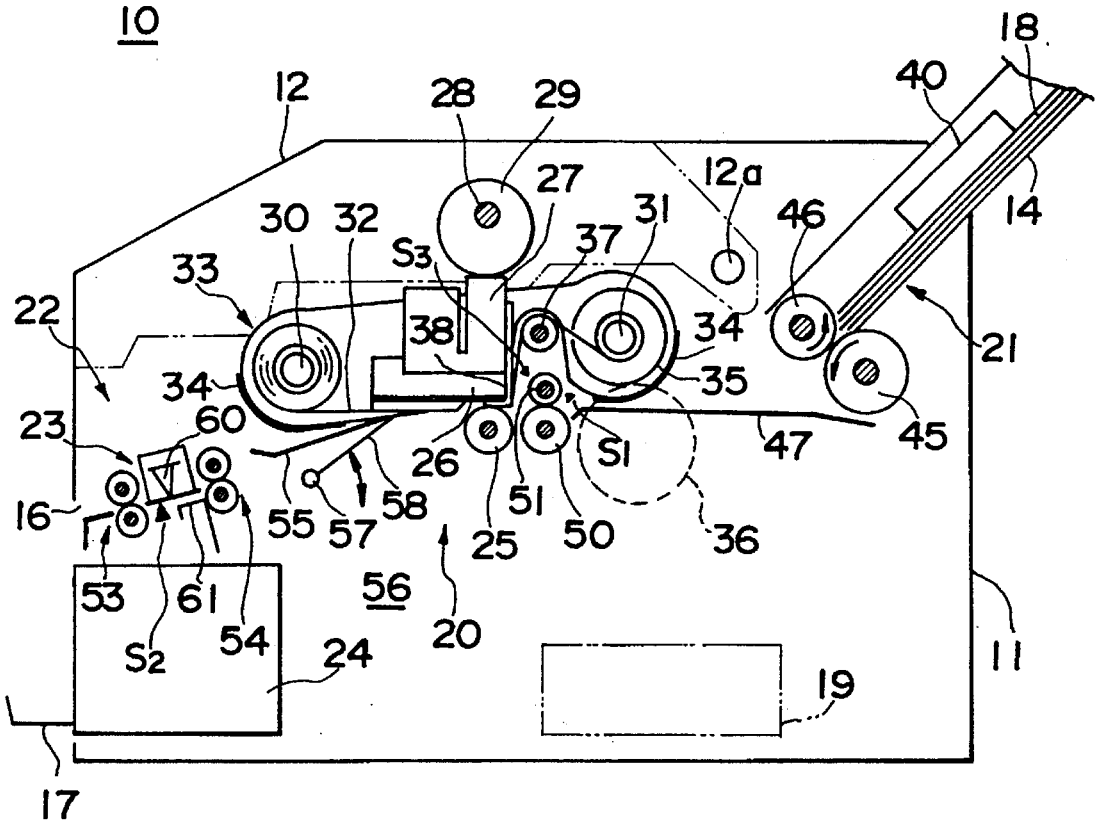
FIG. 3 is a brief section view showing the interior construction of the thermal transfer recording device with the ink film cassette installed.
Figure 4A:
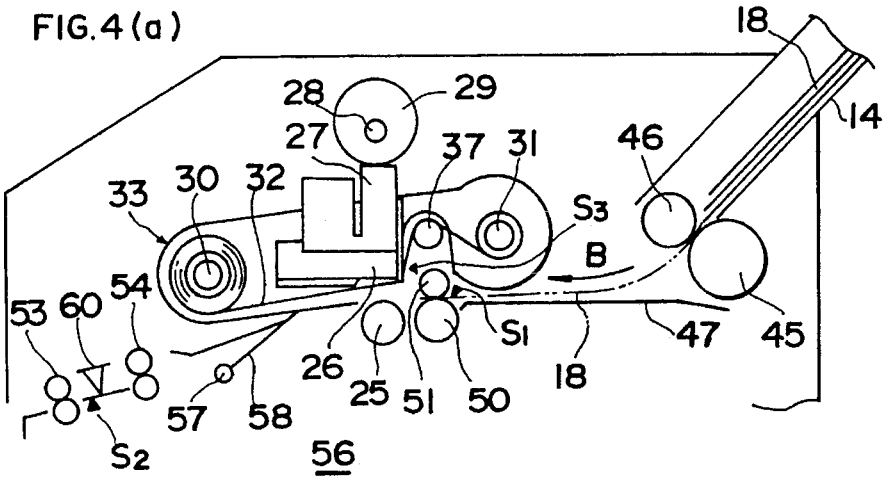
FIG. 4(*a*) is a section view showing the operating state of the thermal transfer recording device when recording medium is supplied.
Figure 4B:
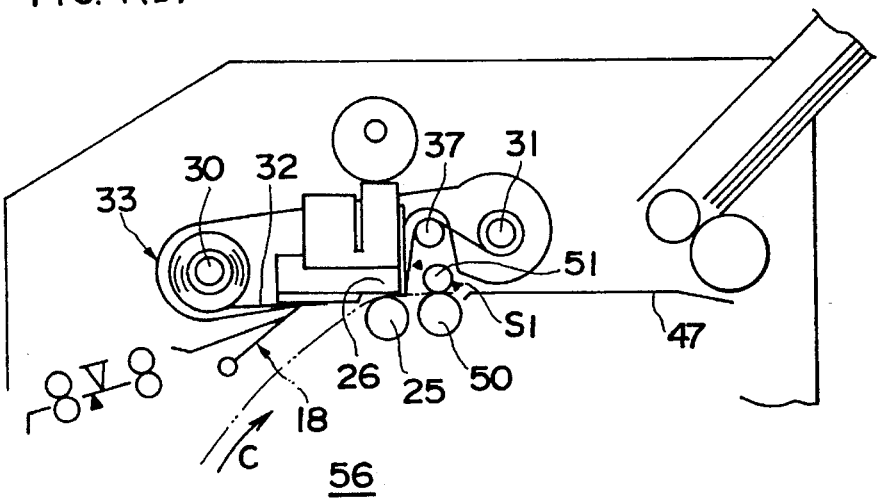
Figure 4C:
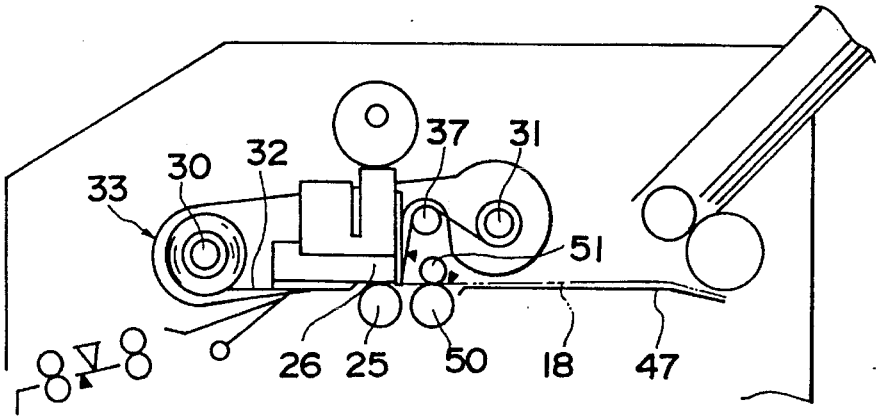

FIG. 2 is a brief section view showing the interior construction of the thermal transfer recording device with the cover open, and FIG. 3 is a brief section view showing the interior construction of the thermal transfer recording device with the ink film cassette installed. FIGS. 4(*a*), 4(*b*), 4(*c*), 5(*a*) and 5(*b*) are perspective views respectively showing the operational state of the thermal transfer recording device during paper supply, start of printing, end of printing, leading edge cutting, and trailing edge cutting.

As shown in FIGS. 2 and 3, the internal construction of thermal transfer recording device 10 is provided with printing section 20 positioned in the center of the device and which transports recording sheet 18 in parallel transport method, sheet supply section 21 disposed at an inclination of about 45° above printing section 20 and positioned at the back of the device, and sheet discharge section 22 provided on the side opposite sheet supply section 21 across printing section 20. The printing quality of thick and stiff recording sheet 18 is improved by using a parallel transport method in printing section 20. The installation space required for the device is minimized by inclining sheet supply section 21, as previously mentioned. By providing discharge section 22 on the side opposite sheet supply section 21 across printing section 20, the convenience for use of the device is as that of facsimile machines, and the device configuration is readily accessible to the user. Discharge section 22 is provided with sheet cutter 23 for cutting the recording sheet 18 as necessary after an image is reproduced, and duster 24 is provided below cutter 23. Control unit 19 is built in to control operations of thermal transfer recording device and execute predetermined image processing relative to image signals input from an external control device.

Further describing the internal construction of thermal transfer recording device 10, within housing 11 a platen roller 25 is rotatably supported, and head base 27 having a thermal head 26 is mounted on the interior surface of cover 12 so as to be capable of advancing and retracting relative to platen roller 25 via a connecting member not shown in the illustration. When head base 27 is advanced relative to platen roller 25, thermal head 26 is moved to a position of pressure contact relative to platen roller 25, and when head base 27 is retracted relative to platen roller 25, thermal head 26 is moved to a position at which pressure contact is released relative to platen roller 25. Head base 27 is forced in the direction indicated by arrow A in FIG. 2 by an elastic means such as a spring or the like (not illustrated) so as to maintain thermal head 26 at a position retracted from platen roller 25, i.e., at a position at which pressure contact is released relative to platen roller 25.

Contact eccentric cam 29 is fixedly mounted on drive shaft 28 rotatably attached to cover 12 so as to abut head base 27 and advance head base 27 such that thermal head 26 comes into pressure contact with platen roller 25. Thermal head drive motor M1 comprising a pulse motor is connected to drive shaft 28 to rotate drive shaft 28 and thereby rotatably drive contact eccentric cam 29. As shown in FIG. 3, when contact eccentric cam 29 is rotated such that the cam center approaches head base 27, said head base 27 is movably advanced such that thermal head 26 is brought into pressure contact with platen roller 25. As shown in FIG. 4, when contact eccentric cam 29 is rotated such that the cam center is removed from head base 27, head base 27 is retracted by the elastic force of the aforesaid spring, thereby releasing the pressure contact of thermal head 26. A cooling fan (not illustrated) is mounted on cover 12 to cool thermal head 26. When cover 12 is closed, cover 12 is fastened to housing 11 by a linking means such as a connector pin (not illustrated).

As shown in FIG. 3, ribbon-like ink film 32, which is fed from supply reel 30 and rolled up on take-up reel 31, passes between thermal head 26 and platen roller 25. Ink film 32 comprises a base film sequentially coated with ink layers of three colors of yellow, magenta, and cyan. Ink films also may be used which are coated with white color ink or an overcoat layer as necessary. Unused ink film 32 is wound upon on supply reel 30, and is rolled up on take-up reel 31 as is used.

Supply reel 30 and take-up reel 31 are accommodated within ink film cassette 33. Film cassette 33 is removably installed in housing 11, and is installed at a predetermined position by placement on support plate 34 mounted within housing 11. Part of gear 35 mounted on take-up reel 31 confronts an opening formed in film cassette 33, such that said gear 35 engages film take-up gear 36 provided on the device body when the cassette is installed. Drive gear 36 is rotatably driven by motor M2. The construction of ink film cassette 33 is described in detail later.

The transport path of ink film 32 is formed by providing rotatable film take-up roller 37 at the insertion position of cassette 33 during cassette installation. Film take-up roller 37 is a roller formed of rubber material the surface of which has high friction resistance, said film take-up roller 37 being driven in rotation by film take-up motor M3 comprising a pulse motor. An electromagnetic clutch (not illustrated) is provided between film take-up motor M3 and film take-up roller 37. The electromagnetic clutch is turned ON only when ink film 32 starts to feed during nonprinting time with thermal head 26 in a state of non-contact with platen roller 25, and is turned OFF during other states, e.g., during printing.

During printing, thermal head 26 is in a state of pressure contact with platen roller 25, and ink film 32 is pulled from supply reel 30 and transported at the same moving speed as recording sheet 18 between platen roller 25 and thermal head 26 via the friction force between the film 32 and recording sheet 18. Ink film 32 fed out from supply reel 30 is guided by film guide panel 38 provided at the leading edge of thermal head 26 and film take-up roller 37 and is rolled up on take-up reel 31 which is rotated by gear 35 and drive gear 36 via motor M2. During printing, the aforesaid electromagnetic clutch is turned OFF, and film take-up roller 37 is rotated via the movement of ink film 32, such that take-up roller 37 functions as a guide roller for the transport of ink film 32.

During non-printing times, thermal head 26 is released from pressure contact relative to platen roller 25. When the film starts to feed, the electromagnetic clutch is turned ON, and film take-up roller 37 is rotated by take-up motor M3. Thus, ink film 32 is pulled from supply reel 30 and rolled up on take-up reel 31 via the friction force between said film 32 and rotating take-up roller 37.

Recording sheet 18 is maintained in an inclined state on supply tray 14, and width regulating member 40 is provided on supply tray 14 to regulate the position of recording sheet 18 in the width direction. Width regulating member 40 is slidably movable in the width direction corresponding to the size of the recording sheet 18. Cover 41 is provided on supply tray 14 to prevent adherence of dust to recording sheet 18 (refer to FIG. 1), and is mounted so as to be operated about a hinge (not illustrated). Cover 41 is formed of transparent material such as acrylic resin and the like to allow the amount of recording sheets 18 remaining in supply tray 14 to be visually ascertained. Reference number 43 in FIG. 1 refers to a handle used to open and close cover 41.

Recording sheet 18 on supply tray 14 is fed therefrom sheet by sheet by feed roller 45 and roller 46 arranged so as to provided a small gap relative to said feed roller 45, and is guided by guide member 47 during transport. Feed roller 45 is rotatably driven by paper supply motor M4 comprising a pulse motor.

Provided adjacent to and on the upstream side of platen roller 25 are grip roller 50 and pinch roller 51 which contacts grip roller 50; recording sheet 18 is transported between said rollers 50 and 51. Grip roller 50 is rotated by grip roller drive motor M5 comprising a pulse motor, and pinch roller 51 is rotated by the transport of the recording sheet.

On the downstream side of platen roller 25 are arranged so as to have a predetermined spacing therebetween first discharge roller pair 53 positioned at discharge aperture 16, and second discharge roller pair 54 positioned at platen roller 25 to discharge recording sheet 18 to discharge tray 17. Discharge roller pairs 53 and 54 are rotated by transport motor M6 comprising a pulse motor, and second discharge roller pair 54 is rotated in a reverse direction by transport motor M6. On the other hand, a one-way clutch permits only first discharge roller pair 53 to move in normal rotation, i.e., the discharge direction of recording sheet 18, is incorporated with a drive gear (not illustrated) which transmits the drive force of transport motor M6 to first discharge roller pair 53. Accordingly, first discharge roller pair 53 cannot move in reverse rotation even when transport motor M6 reverse rotates to reverse rotate second discharge roller pair 54. An operator may remove recording sheet 18 when second discharge roller pair 54 is moving in reverse rotation.

Guide member 55 is provided between platen roller 25 and discharge roller pairs 53 and 54 to guide the transport of recording sheet 18 during nonpaper processing. Below guide member 55 is formed a space 56 for accommodating recording sheets 18 during printing.

In thermal transfer recording device 10 shown in the drawings, when a color image is reproduced on recording sheet 18, first, recording sheet 18 is fed from supply tray 14 and advanced in the arrow B direction, as shown in FIG. 4(*a*), and recording sheet is accommodated in space 56, as shown in FIG. 4(*b*). Then, a yellow image is formed while recording sheet 18 is returned from the aforesaid state in the arrow C direction. That is, a return printing method is used. After a yellow image is formed as recording sheet 18 is return transported, recording sheet 18 is again advanced in preparation for reproducing a subsequent magenta image. Thus, for example, three color images are overlaid and transferred by a surface sequential method to form a color image on recording sheet 18. Thermal head 26 only makes pressure contact with platen roller 25 during return transport, and thermal head 26 and platen roller 25 are separated when recording sheet 18 is advanced. Grip roller 50 and pinch roller 51 normally grip recording sheet 18 continuously during the repeated advance and return transport to accomplish printing.

Figure 5A:
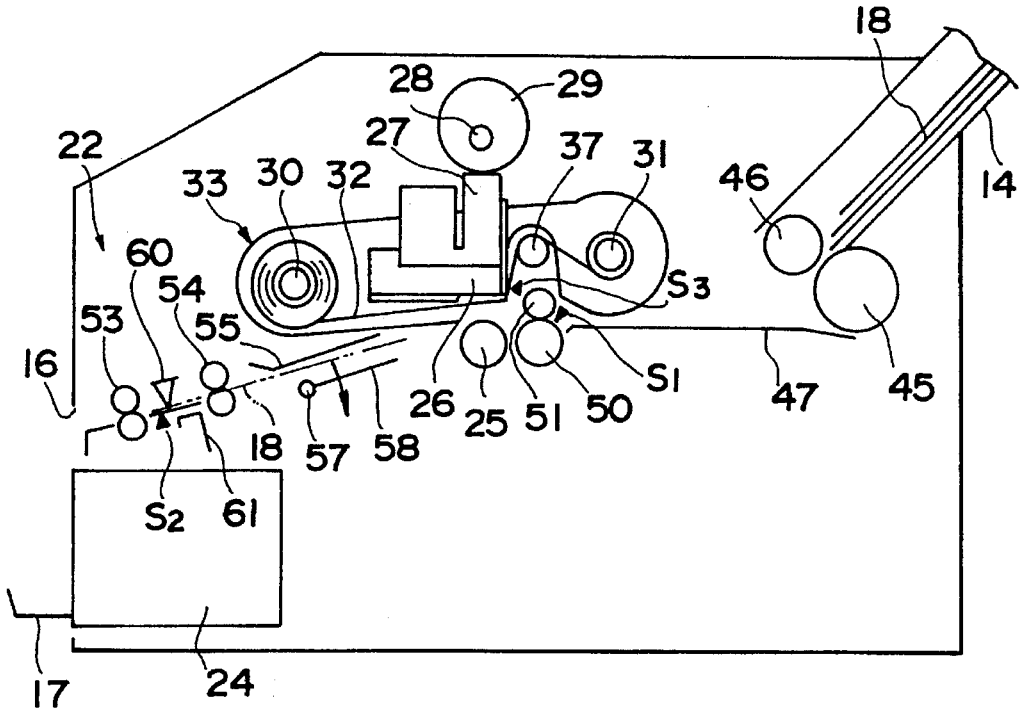
FIG. 5(*a*) is a section view showing the operating state of the thermal transfer recording device when the leading edge of the paper is cut.
Figure 5B:
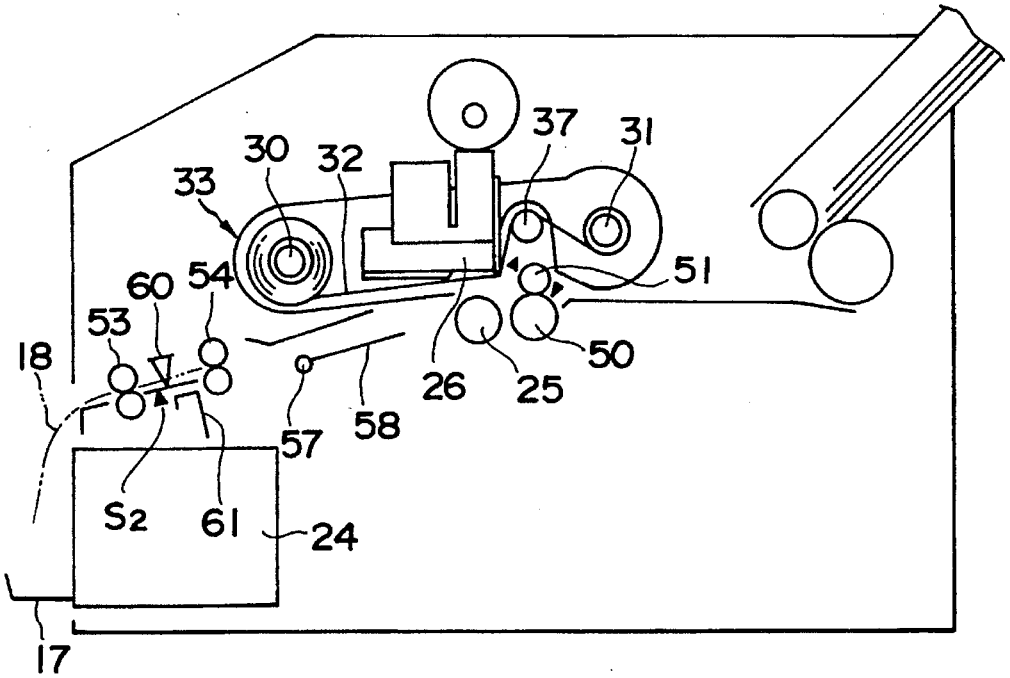

Below the previously mentioned guide member 55 is provided oscillating guide 58, which is oscillatable about support shaft 57, and which selectively guides a recording sheet 18 transported by grip roller 50 and pinch roller 51 to either accommodating space 56 or discharge section 22 provided with discharge roller pairs 53 and 54. Oscillating guide 58 is formed of a flexible material. As shown in FIG. 4(*b*), when oscillating guide 58 is oscillated to the top position, recording sheet 18 transported by grip roller 50 and the like is accommodated in space 56. On the other hand, as shown in FIG. 5(*a*), when oscillating guide 58 is oscillated in a clockwise direction about support shaft 57 from the top position to the bottom position, recording sheet 18 is transported to discharge section 22.

In order to improve printing quality, during printing recording sheet 18 must not be held by discharge roller pairs 53 and 54. When an oscillating guide 58 is provided and a space 56 is formed at a position below the transport path leading to discharge section 22, as in the present embodiment, the distance between platen roller 25 and discharge roller pairs 53 and 54 can be reduced, thereby reducing the floor area occupied by thermal transfer recording device 10.

Cutter unit 23 is provided as a paper cutter between the previously mentioned first discharge rollers pair 53 and second discharge roller pair 54. Cutter unit 23 is provided with cutter 60 and table 61 for cutting recording sheet 18 by mutual operation. The cut sheet fragment falls by its own weight into duster 24 provided at a position below cutter unit 23. Duster 24 is removably installed in housing 11. The top of duster 24 is open, and at least the front surface is formed of transparent material such as acrylic resin or the like such that the amount of paper scraps which can be stored inside are visible from the outside of thermal transfer recording device 10.

Reference number 62 in FIG. 1 refers to a hole which functions as a handgrip formed in the top front surface of duster 24. An operator can remove the duster 24 from housing 11 by inserting fingers in handgrip 62, so as to remove the paper scraps that have accumulated in duster 24.

Figure 6:
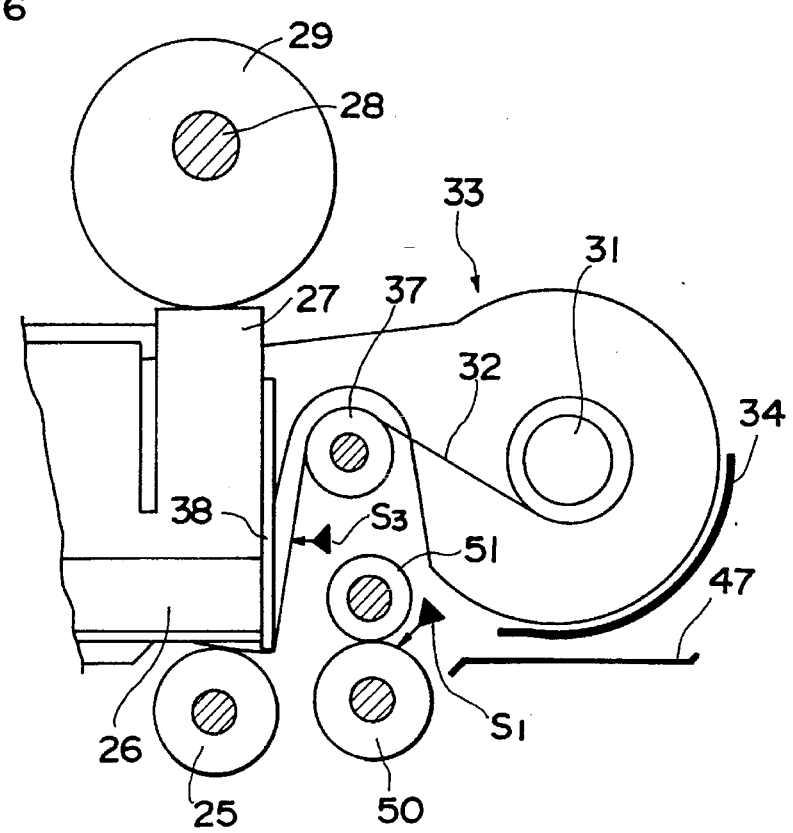
FIG. 6 is an expanded section view showing the essential parts of the printing section of the thermal transfer recording device.

As shown in the enlargement of FIG. 6, sensor S1 is provided adjacent to grip roller 50 to detect the leading edge of a recording sheet during paper supply and the trailing edge of a recording sheet during printing. Sensor S1 generates an ON signal when either the leading edge or trailing edge of recording sheet 18 is detected. Sensor S1 will be referred to hereinafter as "trailing edge sensor S1" because it detects the trailing edge of the recording sheet during printing.

As shown in FIG. 2, cutter unit 23 is provided with leading edge sensor S2 for detecting the leading edge of a recording sheet. Leading edge sensor S2 generates an ON signal when the leading edge of recording sheet 18 is detected. Using the moment at which leading edge sensor S2 detected the leading edge of recording sheet 18 as a reference, pulses driving transport motor M6 are managed to accomplish a leading edge cut to cut the leading edge of recording sheet 18 a predetermined length from its leading edge, and a trailing edge cut to cut the trailing edge of recording sheet 18 a predetermined length from its trailing edge.

As shown in the enlargement in FIG. 6, mark sensor S3 is provided adjacent to film guide roller 37 to detect the starter mark attached to ink film 32. The starter mark reflects each yellow ink layer on the tip of the film. The starting of ink film 32 is accomplished by switching on the electromagnetic clutch rotating film take-up roller 37 via take-up motor M3, so as to transporting ink film 32 via the friction force between said film 32 and take-up roller 37. This starting advances recording sheet 18 until trailing edge sensor S1 detects the trailing edge of recording sheet 18. The starter of the next yellow ink layer switches ON the electromagnetic clutch to continue transporting the film 32 by friction with take-up roller 37, and the amount of transported ink film 32 is determined by pulse count via an encoder (not illustrated) provided at one end of take-up roller 31.

Sensors S1, S2, and $3 are reflective type photosensors in the above example, but are not limited to this type inasmuch as transmission type photosensors also may be used.

Ink film cassette 33 is described in detail hereinafter.

Figure 7:
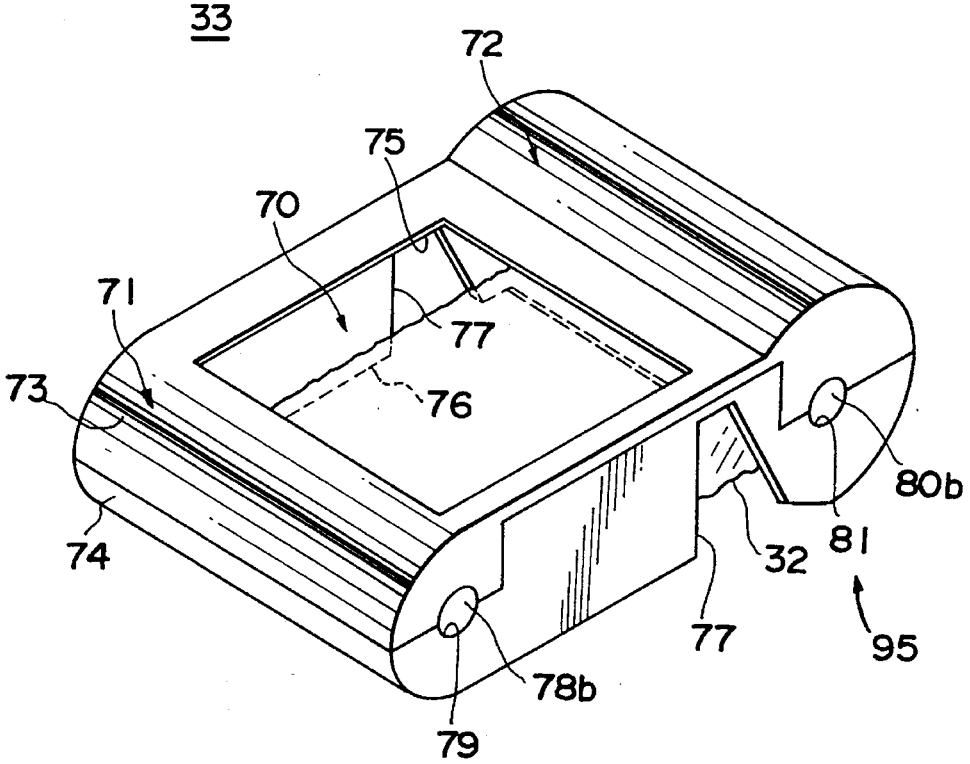
FIG. 7 is an exterior view showing an embodiment of the ink film cassette of the present invention.

As shown in FIG. 7, ink film cassette 33 is provided with center film guide 70, supply reel housing 71 formed at one end of the cassette, and take-up reel housing 72 formed at the other end thereof. These housings are assembled by a top frame 73 and bottom frame 74 formed of synthetic resin which are mutually facing one another. Top window 75 and bottom window 76 are formed at the top and bottom of film guide 70 in the drawing, and notch 77 is formed in side wall of bottom frame 74 to receive take-up roller 37.

As shown in FIGS. 8(*a*)–(*c*) and 9, ink film 32 is wound upon supply reel 30 in supply reel housing 71. Support shafts 78*a* and 78*b* at both ends of supply reel 30 are rotatably supported by bearings 79 formed in the side walls of top and bottom frames 73 and 74. Take-up reel 31 is incorporated within take-up reel housing 72. Supports shafts 80a and 80b at both ends of take-up reel 31 are rotatably supported by bearings 81 formed in side walls of top and bottom frames 73 and 74.

The outside diameter of take-up reel housing 72 is larger than the major diameter of supply-reel housing 71, such that the installation direction is readily discernable when installing ink film cassette 33 in the device. Cassette configuration is a shape that is easily to hold by an operator, and which makes it difficult for the hand of an operator to touch the ink film 32. The coil diameter of ink film 32 on take-up reel 31 is larger than the initial coil diameter on the supply reel to prevent wrinkling of film 32 after printing when all the film on supply reel 30 is rolled up on take-up reel 31. If the major diameter of the take-up reel housing 72 is larger than that of supply reel housing 71, the coil diameter of the ink film after printing may be increased without damage.

Although omitted from the illustrations, if a lip is provided at the joint at which top frame 73 confronts bottom frame 74, both frames 73 and 74 may be accurately adhered because the surface area of mutual contact between both frames 73 and 74 is increased. The aforesaid lip may also be used as a positioning member when installing the ink film cassette 33 inside the device body.

Specifically, in the present embodiment of ink film cassette 33 is provided a first torque limiter 85 corresponding to a first braking means for applying a braking force on shaft 78a of supply reel 30 in cassette 33, said first torque limiter 85 being disposed between cassette 33 and shaft 78*a* of supply reel 30.

Figure 10A:
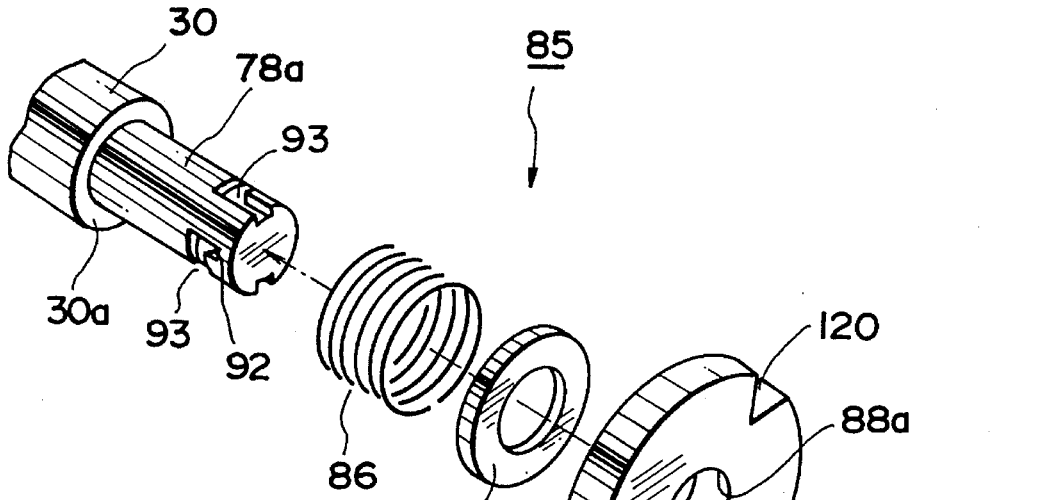
FIG. 10(*a*) is an exploded perspective view showing an example of a first torque limiter.
Figure 10:
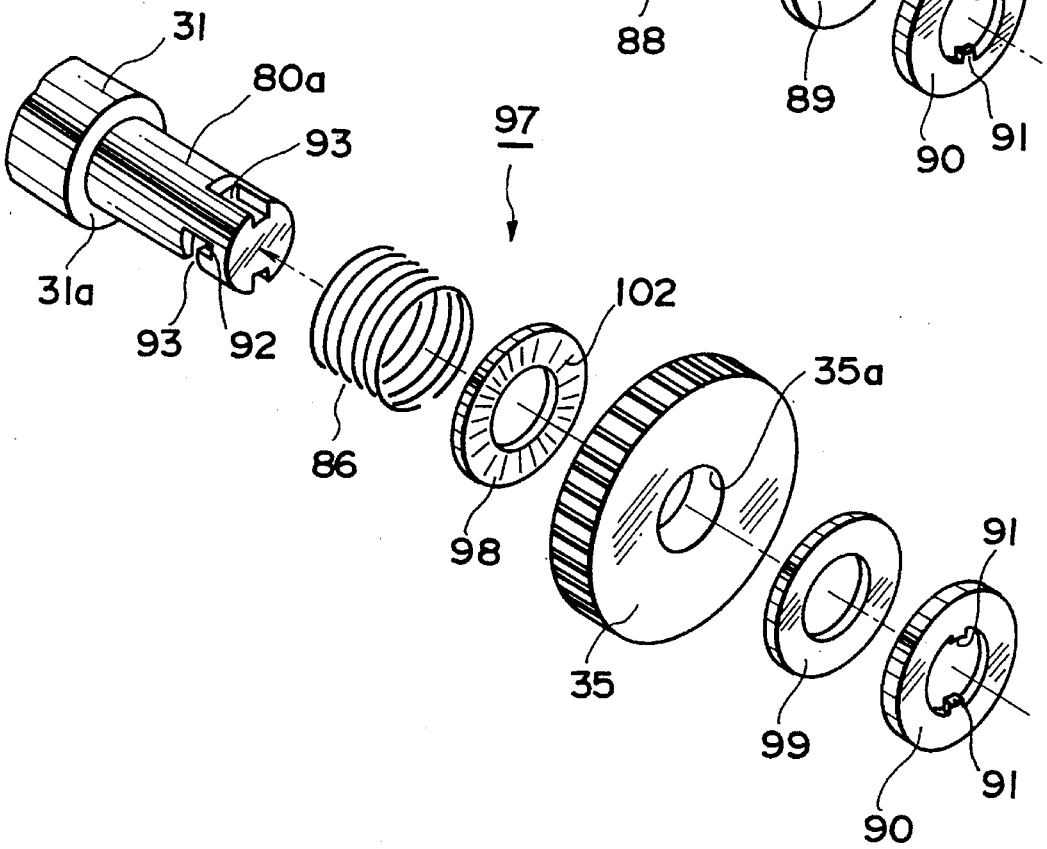

As shown in FIG. 10(*a*), first torque limiter 85 comprises compression coil spring 86, ring-shaped friction plate 87, non-rotating disk member 88, ring-shaped friction plate 89, and ring-shaped spring stopper 90. Friction panel 89 and spring stopper 90 are integratedly formed. The aforesaid components are sequentially inserted on shaft 78*a* of supply reel 30. The outside diameter of shaft 78*a* is smaller than the diameter of supply reel 30, and one end of compression coil spring 86 abuts the end surface of said reel 30. On the interior surface of spring stopper 90 is formed protrusion 91 which protrudes toward the interior, and formed on the exterior surface of shaft 78*a* is a groove 93 provided with a connector 92 which receives and connects to protrusion 91 of spring stopper 90.

In the assembly of first torque limiter 85, compression coil spring 86, friction plate 87, and disk member 88 are sequentially inserted on shaft 78*a*, then, spring stopper 90 integratedly formed with friction plate 89 is inserted on shaft 78a such that protrusion 91 is inserted in groove 93. Thereafter, if spring stopper 90 is rotated in a predetermined direction, protrusion 91 of spring stopper 90, which is acted upon by the elastic force of compression coil spring 86, engages connector 92 of groove 93, so as to be integratedly anchored to shaft 78*a*. Disk member 88 is assembled in a non-rotating state relative to cassette 33, and center hole 88*a* of disk member 88 supports shaft 78*a* so as to allow rotation. Since disk member 88 is assembled in a non-rotating state relative to cassette 33, in the present embodiment, concavity 120 is provided in a part of disk member 88, and a protrusion (not illustrated) having a shape corresponding to the aforesaid concavity is provided in the inner surface of cassette 33, such that rotation of disk member 88 is prevented by the engagement of the aforesaid concavity and protrusion. In this state, disk member 88 is circumscribed by two friction plates 87 and 89 which provide a friction force of compression coil spring 86. Accordingly, supply reel 30 does not rotate unless acted upon by a force greater than the friction force between disk member 88 and friction plates 87 and 89. That is, first torque limiter 85 exerts a braking force on shaft 78a of supply reel 30, and exerts a rotational load on supply reel 30 in cassette 33.

Second braking means 95, which exerts a braking force on shafts 80*a* and 80*b* in cassette 33, is provided between cassette 33 and shafts 80*a* and 80*b* of take-up reel 31.

Figure 11:
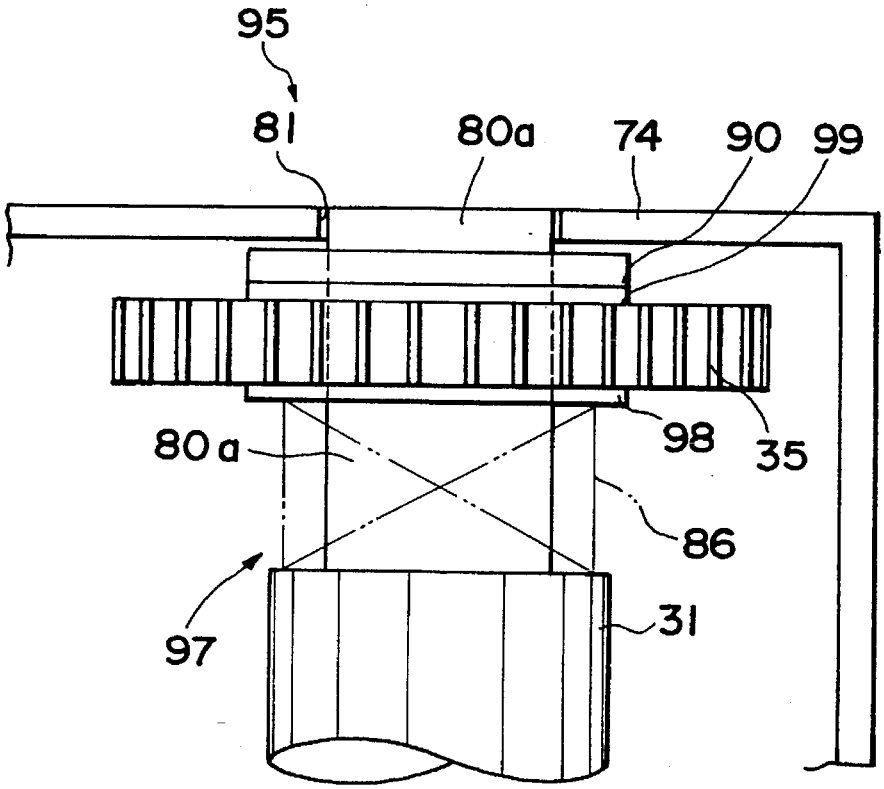
FIG. 11 is a top plan view showing an enlargement of the vicinity of the take-up shaft bearing (second braking means)

Second braking means 95 in the present embodiment comprises take-up bearing 81 supporting shafts 80*a* and 80*b* of take-up reel 31, as shown in the enlargement of FIG. 11. The clearance between take-up bearing 81 and shafts 80*a* and 80*b* is set at a predetermined measurement so as to exert a braking force on shafts 80*a* and 80b, and exert a rotational load on take-up reel 31. While, supply bearing 79, which supports shafts 78*a* and 78*b* of supply reel 30, is formed so as to reduce as far as possible the oscillation resistance of shafts 78*a* and 78*b*.

Ink film cassette 33 is provided with second torque limiter 97 corresponding to a torque restricting means for restricting the drive torque of take-up reel 31 in cassette 33.

Figure 9:
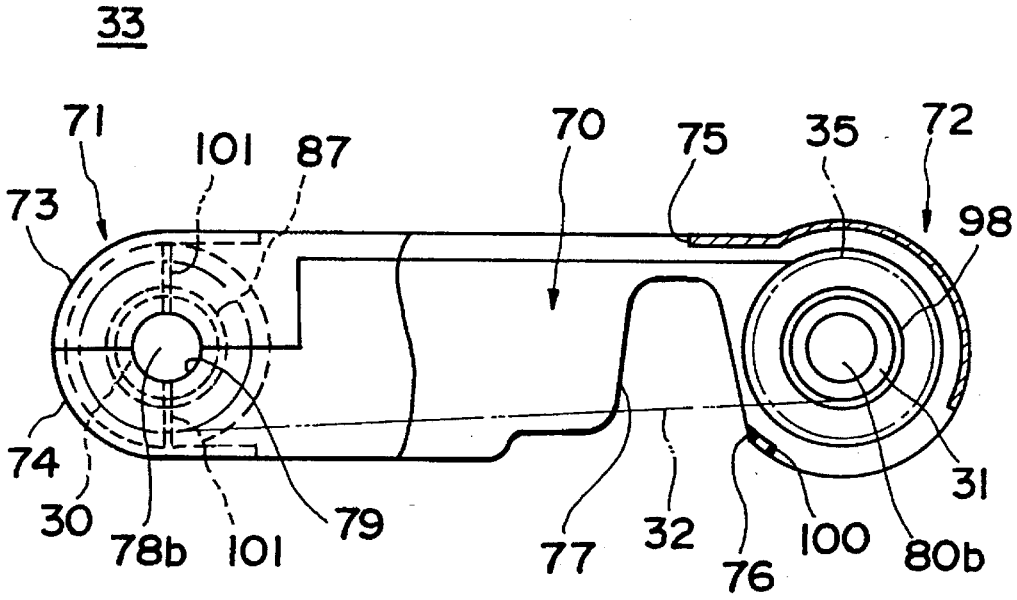
FIG. 9 is a partial section view showing the side of the ink film cassette of FIG. 7.

Second torque limiter 97 comprises compression coil spring 86, ring-shaped friction plate 98, gear 35, ring-shaped friction plate 99, and spring stopper 90 identically to first torque limiter 85, as shown in FIG. 10(*b*). Friction panel 99 and spring stopper 90 are integratedly formed. The aforesaid components are sequentially inserted on shaft 80*a* of take-up reel 31. The outside diameter of shaft 80*a* is smaller than the diameter of take-up reel 31, and one end of compression coil spring 86 abuts the end surface 31*a* of said reel 31. Gear 35 is arranged so as to confront aperture 100 (refer to FIG. 9) formed in bottom frame 74, such that when cassette 33 is installed in the device body, gear 35 engages take-up drive gear 36 through said aperture 100, as previously mentioned.

In the assembly of second torque limiter 97, compression coil spring 86, friction plate 98, and gear 35 are sequentially inserted on shaft 80*a*, then, spring stopper 90 integratedly formed with friction plate 99 is inserted on shaft 80*a* such that protrusion 91 is inserted in groove 93. Thereafter, if spring stopper 90 is rotated in a predetermined direction, protrusion 91 of spring stopper 90, which is acted upon by the elastic force of compression coil spring 86, engages connector 92 of groove 93, so as to be integratedly anchored to shaft 80*a*. Center hole 35*a* of gear 35 supports shaft 80*a* so as to allow rotation. In this state, gear 35 is circumscribed by two friction plates 98 and 99 which provide a friction force of compression coil spring 86. Accordingly, when a drive torque acts on gear 35 which is greater than the friction force exerted by friction plates 98 and 99, only gear 35 idles and take-up reel 31 does not rotate.

As shown in the partial enlargement of FIG. 8, the clearance between each reel 30 and 31 and cassette 33 in the axial direction is minimized to reduce the thrust backlash of reels 30 and 31. When clearance is reduced in the axial direction, the oscillation resistance of bilateral endfaces 30*b* and 31*b* of reels 30 and 31 is increased relative to cassette 33, such that protrusion 101 is provided on the interior surface of the cassette to abut said endfaces 30*b* and 31*b* in the axial direction (refer to FIG. 9). By providing the aforesaid protrusions 101, an air layer is provided between the interior cassette surface and endfaces 30*b* and 31*b* in the axial direction, and the contact surface area of reel endfaces 30*b* and 31*b* are reduced, such that oscillation characteristics of reels 30 and 31 are excellent relative to cassette 33.

First and second torque limiters 85 and 97 can be readily assembled by placing compression coil spring 86, friction plates 87 and 98, and disk member 88 or gear 35, and seating spring stopper 90 integratedly formed with friction plate 89 or 99. Assembly can be readily automated and done on an assembly line because compression coil spring 86 and like components are installed on shafts 78*a* and 80*a* unidirectionally.

The torque value of supply side first torque limiter 85 is set larger than the torque value of take-up side second torque limiter 97. Because second braking means 95 exerts a rotational load on take-up reel 31, the set torque value of second torque limiter 97 is set at a value in consideration of the rotational load of take-up reel 31.

Different torques are set on the supply side and take-up side. In the present embodiment, the surfaces of friction plates 87 and 89 of first torque limiter 85 are smooth, and the surfaces of friction plates 98 and 99 of second torque limiter 97 are provided with patterned dimples 102 to provide the aforesaid torque differential. Friction plates 98 and 99 provided with patterned dimples 102 provide an airspace between endfaces of gear 35 in the axial direction, and reduce the contact surface area of the gear endfaces, such that the readily slide compared to smooth friction plates 87 and 89, and torque values can be reduced.

Friction plates 87, 89, 98, and 99 are all formed of the same materials, and the surface roughness can be changed by the present or absence of patterned dimples 102. In such a case, the torque differential is easily maintained because each friction plate 87, 89, 98, 99 exhibit the same action when the operating temperature changes in ink film cassette 33. Materials usable for forming the friction plates 87, 89, 98, and 99 should be materials which are relatively stable relative to temperature changes, e.g., silicone. If changes in the torque differential are restricted within an allowable range even with temperature variations, supply side friction plates 87 and 89 and take-up side friction plates 98 and 99 may be formed of different materials.

Friction plates 87 and 89 of first torque limiter 85 may be, for example, black in color, and friction plates 98 and 99 of second torque limiter 97 may be, for example, white in color, so as to prevent erroneous assembly of said friction plates 87, 89, 98, and 99. Similar compression-coil springs 86 may be used in both torque limiters 85 and 97, so as to reduce the number of different components and prevent errors during assembly.

In ink film cassette 33 of the present embodiment, it is unnecessary to provide a supply side torque limiter and a take-up torque limiter within the body of thermal transfer recording device because first and second torque limiters 85 and 97 are provided within the cassette. Thus, the construction of the device can be simplified and cost of the device reduced by avoiding torque limiters in the device body. Furthermore, the device can be constructed more compactly.

First and second torque limiters 85 and 97 provided in ink film cassette 33 need not have the same durability as other components within the device body, and said torque limiters may have a durability sufficient for normal operation in completely using the ink film accommodated within the cassette, for example, forming images of 100 frames. Thus, first and second torque limiters can be made relatively more inexpensively than conventional torque limiters, thereby reducing the component cost, as well as reducing the cost of the entire device.

In cassette 33, since first torque limiter 85 is provided to exert a braking force on shaft 78*a* of supply reel 30, ink film 32 does not become slack and feed out during shipping or transport of consumable cassette 33 even if an external force is applied, such that waste of unused ink film 32 is prevented. Similarly, when ink film cassette 33 is removed from thermal transfer recording device 10 during use of ink film 32, unused ink film 32 does not feed out from supply reel 30 even when an external force is applied, such that waste of unused ink film 32 is prevented.

Since a rotational load is applied to take-up reel 31 in cassette 33 by second braking means 95 comprising take-up bearing 81, used ink film 32 does not feed out from take-up reel 31 when ink film cassette 33 has been removed from the thermal transfer recording device during use of ink film 32 even if an external force is applied, thereby preventing damage to ink film 32.

First torque limiter 85 and second braking means 95 provided in cassette 33 possess a stopper function to prevent rotation of supply reel 30 and take-up reel 31 during transport of ink film cassette 33, such that it is unnecessary to provide special stopper mechanisms, and thereby complicate the construction of ink film 33. Since a stopper is mounted on the shaft, a special operation to prevent feed out of the ink film is unnecessary.

Since the value of supply side torque limiter 85 is set greater than the value of take-up side second torque limiter 97, when take-up reel 31 is rotated, slack ink film 32 is tensioned in conjunction with winding of take-up reel 31. Thereafter, the drive torque acting on gear 35 becomes greater than the friction force between friction plates 98 and 99 such that only gear 35 idles even when take-up reel 31 rotates, and ink film 32 cannot be pulled from supply reel 30.

Since the value of first torque limiter 85 is set greater than the value of second torque limiter 97, when thermal head 26 drops for printing and comes into pressure contact with platen roller 25, used ink film 32 is pulled from take-up reel 31 without pulling unused ink film 32 from supply reel 30, such that unused ink film 32 is not wasted. Therefore, the ink region of each color can be reduced, and the number of ink regions coating the film 32 can be increased even for a film of the same length, thereby increasing the number of images that can be formed.

Figure 12:
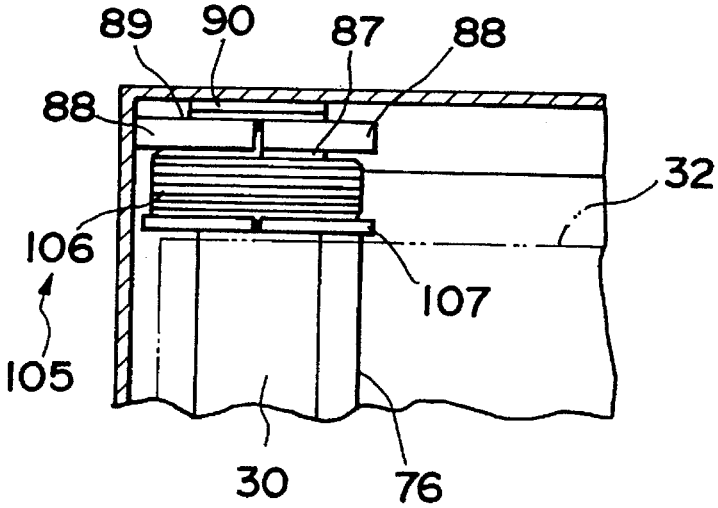
FIG. 12 is a transverse section view showing the essential portion of another embodiment of the ink film cassette of the present invention.

FIG. 12 is a section view showing the essential portion of a second embodiment of the ink film cassette. In addition to the construction of ink film cassette 33 of the first embodiment, ink film cassette 33 of the second embodiment provides on supply reel 30 in cassette 33 a rewind means 105 for forcibly rewinding ink film 32 fed out from supply reel 30 back on supply reel 30.

Rewind mean 105 exerts a force on supply reel 30 to rotate reel 30 in a direction to rewind ink film 32, and may be constructed, for example, by kick spring 106 as shown in the drawing. One end of kick spring 106 is anchored to disk member 88, and the other end is attached to lip 107 provided on supply reel 30. When ink film 32 is fed from supply reel 30 elastic force is stored in kick spring 106, and when ink film 32 stops feeding from supply reel 30, supply reel 30 is rotated in a rewinding direction by said elastic force so as to rewind ink film 32.

In thermal transfer recording device 10, when recording sheet 18 is advanced in preparation for printing a next color after printing of certain color has been completed, the pressure contact of thermal head 26 relative to platen roller 25 is temporarily released. At this time, ink film 32 is in a slack state, and normally ink film 32 is slightly taken up by take-up reel 31 to eliminate the slack. Slack ink film 32 is forcibly rewound on supply reel 30 by kick spring 106 provided on supply reel 30 as in the second embodiment, such that ink film 32 is maintained in a tensioned state. Accordingly, dislocation of the printing point on ink film 32 is difficult whether or not thermal head 26 is in a state of contact or non-contact relative to platen roller 25, such that the ink regions of ink film 32 may be economized. Since the ink region of each color can be reduced, the number of ink regions coating a film 32 of the same length may be increased, thereby making it possible to increase the number of images formed.

When kick spring 106 is provided on supply reel 30 and a rotational load larger than the kick spring force is exerted on take-up reel 31, all the energy stored in kick spring 106 cannot be used when rewinding ink film 32 on supply reel 30 due to the high load exerted on take-up reel 31. Therefore, when ink film cassette 33 is removed from thermal transfer recording device 10, ink film 32 is maintained in a tensioned state without slack by means of the force exerted by kick spring 106 provided on supply reel 30 and the rotational load exerted on take-up reel 31.

First torque limiter 85 and second torque limiter 97 are not restricted to the constructions of the first embodiment and may be variously modified as described below.

For example, although disk member 88 and gear 35 have been described as being circumscribed by friction plates 87 and 89 and 98 and 99, respectively from the endfaces in the axial direction, alternatively friction plates 87 and 98 on the compression coil spring 86 side may be eliminated, and the surface smoothness of axial direction endfaces of disk member 88 and gear 35 may be increased to improve the sliding of compression coil spring 86, with disk member 88 and gear 35 circumscribed by compression coil spring 86 and friction plates 89 and 99. In such a configuration, predetermined function of the torque limiter can be sufficiently realized. Such a construction also allows a reduction in the number of components comprising torque limiters 85 and 97, and cost reduction and simplification of assembly can be realized by said reduction in the number of components.

If friction plates 87 and 98 are adhered to plate metal, flexible friction plates 87 and 98 can be readily inserted on shafts 78*a* and 80*a*.

Furthermore, friction plates 89 and 99 need not be integratedly formed with spring stopper 90, and may be separate members which are separately inserted on shafts 78*a* and 80*a*. At such time, friction plates 89 and 99 may be adhered to plate metal.

Groove 93 of shafts 78*a* and 80*a* may be extended to endface 30*a* of supply reel 30 or endface 31*a* of take-up reel 31, and protrusions 91' which are inserted into groove 93 may be formed on friction plates 87 and 98 (and on friction plates 89 and 99 when friction plates 89 and 99 are not integratedly formed with spring stopper 90), so as to be integrated with the each shaft when said friction plates 87, 98, 89, and 99 are inserted on shafts 78*a* and 80*a*.

Figure 13:
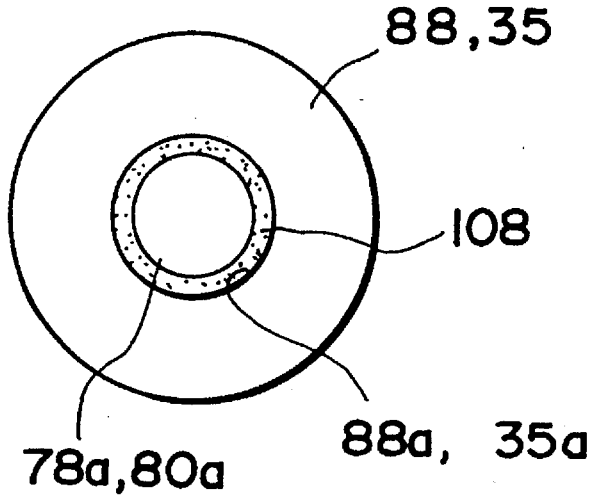
FIG. 13 shows a modification of the disk member of the first torque limiter and the gear of the second torque limiter.
Figure 14:
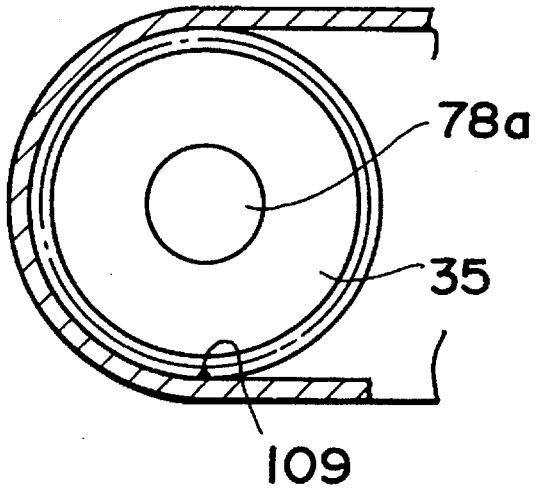
FIG. 14 shows a modification of the disk member of the first torque limiter.

Center hole 88*a* of disk member 88 and center hole 35*a* of gear 35 oscillate relative to shafts 78*a* and 80*a*, and in consideration of fluctuation in environmental temperature, buffer member 108 comprising a cork material or rubber material may be provided in center holes 88*a* and 35*a*, as shown in FIG. 13. According to this construction, changes in oscillation characteristics due to fluctuations in environmental temperature may be inhibited.

Although disk member 88 and gear 35 have been described as individual member, gear 35 comprising second torque limiter 97 may be used as disk member 88 comprising first torque limiter 85, and protrusion 109 may be provided having a shape corresponding to the gear teeth on the interior surface of cassette 33 and when said members are engaged the rotation of gear 35 is prevented, thereby fulfilling the function of disk member 88. In this circumstance, components of torque limiters 85 and 97 use common components on both the supply side and take-up side, thereby reducing component cost.

Figure 15:
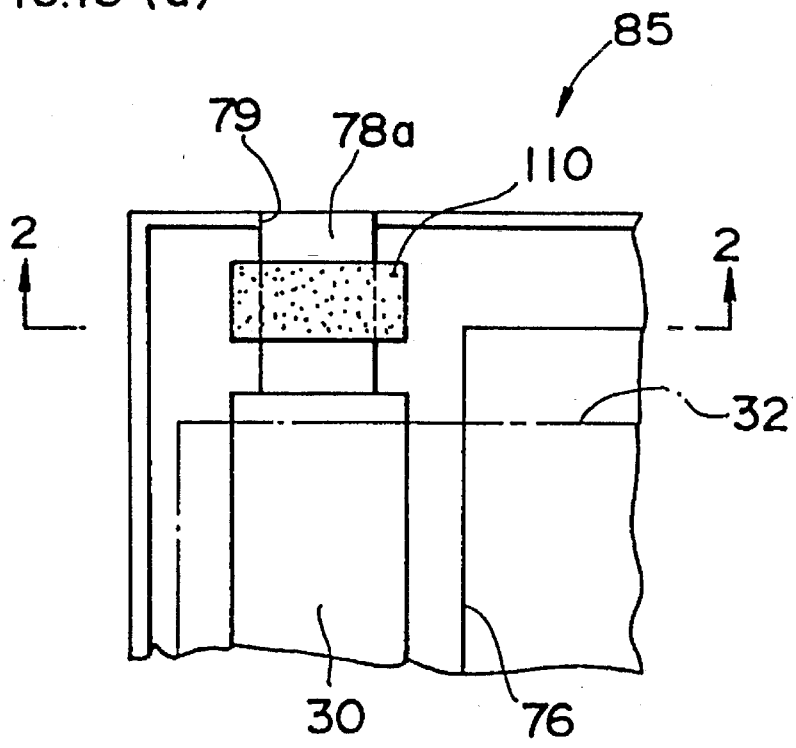
FIG. 15(*a*) is a top plan view showing another modification of the first torque limiter.
Figure 15:
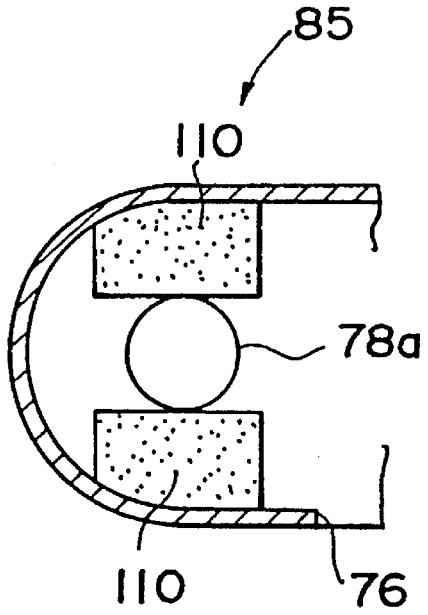

As shown in FIGS. 15(*a*) and 15(2), first torque limiter 85 may be constructed by adhering on the interior surface of cassette 33 an elastic member such as sponge 110 which rubs the exterior surface of shaft 78*a* of supply reel 30, so as to exert a rotational load on supply reel 30 via sponge 110. In this construction, the number of components comprising torque limiter 85 is reduced, thereby conserving space within cassette 33. Second torque limiter 95 also provides on the interior surface of cassette 33 with an elastic member such as a sponge or the like which rubs the exterior surface of shaft 80*a* of take-up reel 31, so as to exert a rotational load on take-up reel 31 via the sponge.

The operation of thermal transfer recording device 10 shown in the drawings is described hereinafter with reference to FIGS. 4(*a*)~4(*b*) and FIGS. 5(*a*) and 5(*b*).

Sheet Feeding (refer to FIG. 4(*a*)

In the initial state, i.e., the state wherein recording sheet 18 and ink film cassette 33 are loaded, when a print command is output from a control device (not illustrated), feed roller 45 is rotated by feed motor M4 (refer to FIG. 2), so as to feed only a single recording sheet 18 through the small gap between said roller 45 guide roller 46.

Feed motor M4 is stopped when recording sheet 18 is advanced in the arrow B direction via the rotation of feed roller 45 and the leading edge of the recording sheet is detected by trailing edge sensor S1. At this time, the leading edge of recording sheet 18 is gripped between grip roller 50 and pinch roller 51. Then, grip roller 50 is rotated via grip roller motor M5 (refer to FIG. 2) to advance recording sheet 18 in the arrow B direction, and grip roller motor M5 is stopped when the trailing edge of said recording sheet 18 is detected by trailing edge sensor S1. The advance of recording sheet 18 occurs with the thermal head 26 in a state of separation relative to platen roller 25. Oscillation guide 58 is oscillated to the top position, and recording sheet 18 is accommodated in space 56.

At the same time the sheet is fed, motor M2 and film take-up motor M3 are actuated, such that ink film 32 is pulled from the supply reel and rolled up on take-up reel 31 via take-up roller 37, thereby eliminating the slack in ink film 32 and starting ink film 32. When mark sensor S3 detects the starter mark attached to ink film 32, motor M2 and take-up roller M3 are stopped.

Printing Start (FIG. 4(*b*))

Contact eccentric cam 29 is rotated by thermal head drive motor M1 (refer to FIG. 2), so as to bring thermal head 26 into pressure contact with platen roller 25. Then, grip roller 50 is rotated by grip roller drive motor M5 to return transport recording sheet 18 in the arrow C direction, and printing starts directly after the trailing edge of the recording sheet is detected by trailing edge sensor S1 to form a yellow image on recording sheet 18. The transport system for return transport of recording sheet 18 during printing comprises only grip roller 50.

Printing End (FIG. 4(*c*)

Since there is a possibility that ink may be transferred to platen roller 50 when printing to the leading edge of the recording sheet, printing is stopped while recording sheet 18 remains disposed between platen roller 25 and ink film 32, and the return transport of recording sheet 18 is also stopped. Contact eccentric cam 29 is rotated by thermal head drive motor M1, so as to release the pressure contact of thermal head 26 relative to platen roller 25.

When next color printing or overcoat printing is necessary, recording sheet 18 is advanced by grip roller 50 and guided to space 56, as shown in FIG. 4(*b*). Advance of recording sheet 18 to the printing start position is accomplished by actuating grip roller drive motor M5 a predetermined number of pulses.

At the same time as such preparation for next color printing, motor M2 and film take-up motor M3 are actuated and the amount of transport of ink film 32 is determined by a motor pulse count via an encoder provided at one end of take-up roller 31 to start the next ink layer. The next color is printed by executing the previously described printing operation. This operation is repeated for all colors, or overcoat printing.

Leading Edge Cutting (FIG. 5(*a*)

When all color printing or overcoat printing has been completed, the pressure contact of thermal head 26 is released relative to platen roller 25, and oscillation guide 58 is oscillated to the bottom position. Recording sheet 18 advanced by grip roller 50 is directed to discharge section 22. Transport motor M6 is actuated with a predetermined timing so as to advance recording sheet 18 via second discharge roller pair 54. When leading edge sensor S2 detects the leading edge of recording sheet 18, grip roller drive motor M5 and transport motor M6 are stopped.

Then, transport motor M6 is actuated only a number of pulses corresponding to a predetermined length from the leading edge of the recording sheet, so as to advance recording sheet 18 toward cutter unit via second discharge roller pair 54. When transport of recording sheet 18 is stopped, recording sheet 18 is cut a predetermined length from the leading edge of the sheet via the joint operation of rotary cutter 60 and table 61. The cut sheet fragment drops into duster 24 via its own weight.

Trailing Edge Cutting (FIG. 5(*b*)

When the cutting of the leading edge has been completed, transport motor M6 is actuated only a number of pulses corresponding to a predetermined length, so as to transport recording sheet 18 via first discharge roller pair 53 and second discharge roller pair 54. Thereafter, rotary cutter 60 is operated to cut the trailing edge of recording sheet 18 at a predetermined length.

At the time the trailing edge cutting has been completed, recording sheet 18 on which a color image has been reproduced is gripped by first discharge roller pair 53, and the unnecessary cut sheet fragment is gripped by second discharge roller pair 54. Then, transport motor M6 is reverse rotated only a predetermined number of pulses to reverse rotate second discharge roller pair 54, and return the sheet fragment to printing section 20. Thus, the sheet fragment is separated from second discharge roller pair 54 and falls into duster 24. Recording sheet 18 remains gripped by first discharge roller pair 53 because the first discharge roller pair 53 does not reverse rotate via the action of the one-way clutch even when transport motor M6 reverse rotates. An operator may remove recording sheet 18 from first discharge roller pair 53 even though transport motor M6 is driven in reverse rotation.

When the collection of the sheet fragment is completed, transport motor M6 is driven in standard rotation a predetermined number of pulses, and recording sheet 18 is transported by first discharge roller pair 53 so as to be discharged to discharge tray 17.

According to the ink film cassette of the present invention, ink film is prevented from feeding out from a supply reel due to the application of an external force when the ink film cassette is being shipped or when an ink film cassette is removed from a thermal transfer recording device during use of the cassette because a first torque limiter exerts a braking force on the shaft of the supply reel in the cassette, thereby eliminating waste of unused ink film.

Furthermore, it is unnecessary to provide a supply side torque limiter within the thermal transfer recording device because a braking force is exerted on the shaft if the supply reel within the cassette, thereby simplifying the construction of the thermal transfer recording device while both reducing the cost and improving compactness of the thermal transfer recording device. Since the durability of the first torque limiter need only be sufficient for normal operation until the accommodated ink film is completely consumed, construction is less expensive than a supply side torque limiter provided within the thermal transfer recording device, and the cost of the entire thermal transfer recording device is markedly reduced through the reduction in component costs.

Furthermore, used ink film is prevented from feeding out from a take-up reel due to the application of an external force when an ink film cassette is removed from a thermal transfer recording device during use of the cassette because a second braking means exerts a braking force on the shaft of the take-up reel in the cassette, thereby eliminating damage to the ink film.

Still further, it is unnecessary to provide a take-up side torque limiter within the thermal transfer recording device because a second torque restricting means restricts the drive torque applied to the take-up reel within the cassette, thereby simplifying construction of the thermal transfer recording device while both reducing the cost and improving compactness of the thermal transfer recording device. Since the durability of the torque restricting means need only be sufficient for normal operation until the accommodated ink film is completely consumed, construction is less expensive than a take-up side torque limiter provided within the thermal transfer recording device, and the cost of the entire thermal transfer recording device is markedly reduced through the reduction in component costs.

Slackness of the ink film is automatically eliminated and the ink film maintained in a tensioned state because the rewind means (kick spring) provided in the cassette rewinds the ink film fed out from the supply reel onto said supply reel. Accordingly, there is no dislocation of the printing spot on the ink film regardless of whether or not the thermal head is in a state of contact or non-contact relative to the platen roller, thereby economizing on both ink and ink film, and making it possible to reduce the size of the ink regions on the film.

There is no slack in the ink film which is maintained in a tensioned state when the ink film cassette is being transported and when an ink film cassette is removed from the thermal transfer recording device during use.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An ink film cassette which is detachably attached to a thermal transfer recording device, comprising:

a supply reel winding an ink film therearound;

a take-up reel which rolls up the ink film fed out from said supply reel;

a frame accommodating said supply reel and said take-up reel; and a torque apply means provided between said supply reel and said frame so as to apply torque to said supply reel.

2. The ink film cassette as claimed in claim 1, wherein said torque apply means is a torque limiter which is provided on an end portion of said supply reel.

3. The ink film cassette as claimed in claim 2 wherein said torque limiter includes a plate member engaged with said of the, at least one friction plate and a coil which are provided on a shaft of the supply reel at an end portion of the supply reel.

4. The ink film cassette as claimed in claim 1, wherein said torque apply means includes sponges adhering on an interior surface of the cassette so as to rub an exterior surface of a shaft of said supply reel.

5. The ink film cassette as claimed in claim 1 further comprising a breaking means which applies a breaking force to the take-up reel.

6. The ink film cassette as claimed in claim 5 wherein said breaking means applies the breaking force by setting a clearance between a shaft of the take-up reel and a bearing which supports the shaft to a predetermined size.

7. The ink film cassette as claimed in claim 1 further comprising a second torque limiter which transmits to said take-up reel driving force generated by a driving section provided in a body of the thermal transfer recording device therethrough so as to limit driving torque of said take-up reel.

8. The ink film cassette as claimed in claim 7, wherein the value of torque applied to the supply reel by said torque apply means is set to be greater than the value of torque limited by said second torque limiter.

9. The ink film cassette as claimed in claim 1 further comprising a rewinding member provided on the supply reel and rewinding an ink film which is fed out from the supply reel to the supply reel.

10. The ink film cassette as claimed in claim 9, wherein said rewinding member is a spring member, one end of the spring member being attached to the supply reel and the other end of the spring member being attached to a plate member engaged with said frame.

11. The ink film cassette as claimed in claim 1, wherein a part of said frame in which the take-up reel is incorporated and a part of said frame in which the supply reel is incorporated are circular in cross-section, and the outside diameter of the former is larger than the outside diameter of the latter.

12. An ink film cassette which is detachably attached to a thermal transfer recording device, comprising:

a supply reel winding an ink film therearound;

a take-up reel which rolls up the ink film fed out from said supply reel;

a frame accommodating said supply reel and said take-up reel;

a first torque limiter provided between said supply reel and said frame so as to apply torque to said supply reel; and a second torque limiter which transmits to said take-up reel driving force generated by a driving section provided in a body of the thermal transfer recording device therethrough.

13. The ink film cassette as claimed in claim 12 further comprising a breaking means which applies a breaking force to the take-up reel.

14. The ink film cassette as claimed in claim 12 further comprising a rewinding member provided on the supply reel and rewinding an ink film which is fed out from the supply reel to the supply reel.

15. An ink film cassette which is detachably attached to a thermal transfer recording device, comprising:

a supply reel winding an ink film therearound;

a take-up reel which rolls up the ink film fed out from said supply reel; and a housing accommodating said supply reel and said take-up reel, said housing being arranged so that a space accommodating said take-up reel is larger than a space accommodating said supply reel.

* * * * *

UNITED STATES PATENT AND TRADEMARK OFFICE

CERTIFICATE OF CORRECTION

PATENT NO. : 5,622,440

DATED : April 22, 1997

INVENTOR(S) : Junichi Yamamoto et al

It is certified that error appears in the above-indentified patent and that said Letters Patent is hereby corrected as shown below:

Column 17, line 37, delete "of".

Column 17, line 38, delete "the" and insert --frame--.

Signed and Sealed this

Seventh Day of April, 1998

Bruce Lehman

*Attest:*

BRUCE LEHMAN

*Attesting Officer*

*Commissioner of Patents and Trademarks*